United States Patent [19]

Berzin

[11] Patent Number: 4,962,812

[45] Date of Patent: Oct. 16, 1990

[54] VALVING SYSTEM FOR INFLATABLE PACKERS

[75] Inventor: Vel Berzin, Houston, Tex.

[73] Assignee: Baker Hughes Incorporated, Houston, Tex.

[21] Appl. No.: 448,522

[22] Filed: Dec. 11, 1989

[51] Int. Cl.[5] ..... E21B 33/127; E21B 34/06

[52] U.S. Cl. ..... 166/187; 166/317; 166/321

[58] Field of Search ..... 166/187, 321, 320, 317; 277/34, 34.6; 137/70, 71

[56] References Cited

U.S. PATENT DOCUMENTS

| | | | |
|---|---|---|---|
| Re. 32,345 | 2/1987 | Wood | 166/187 X |
| 4,260,164 | 4/1981 | Baker et al. | 277/34 |
| 4,402,517 | 9/1983 | Wood et al. | 166/187 X |
| 4,421,165 | 12/1983 | Szarka | 166/187 X |
| 4,474,380 | 10/1984 | Carter, Jr. | 277/34.6 |
| 4,577,696 | 3/1986 | Suman | 166/187 |
| 4,586,526 | 5/1986 | Reardon | 166/187 X |
| 4,653,588 | 3/1987 | White | 166/187 X |
| 4,711,301 | 12/1987 | Stringfellow | 166/187 |

OTHER PUBLICATIONS

Baker Service Tools brochure entitled "UNIT 4259", Mar. 15, 1988, pp. 1–20.

*Primary Examiner*—Hoang C. Dang

*Attorney, Agent, or Firm*—Hubbard, Thurman, Turner & Tucker

[57] ABSTRACT

Existing inflatable packers employ a three valve system for controlling the application of tubing pressure to the interior of an inflatable packing element surrounding the tubing. The three valves of such system are disposed in chordal relationship in the tubular wall of a valve collar which is secured to one end of the inflatable packing element. The valves employed are respectively an inflation initiating valve, a check valve and an inflate limit valve which are serially connected insofar as fluid flow is concerned. Because of the configuration of the flow passages, damage caused by fluid flow is much more severe on the check valve and inflate limit valve. Since no increase in diameter of the check and inflate limit valve can be tolerated, a duplicate set of such valves are provided in the tubular wall of the valve collar with the two sets of check valves and inflate limit valves connected in parallel to essentially double the effective flow area through such valves.

6 Claims, 2 Drawing Sheets

VALVING SYSTEM FOR INFLATABLE PACKERS

BACKGROUND OF THE INVENTION

1. Field of the Invention

The invention relates to a valving system for effecting the inflation of an inflatable packer.

2. Summary of the Prior Art

As schematically shown in FIGS. 1 and 2 of the drawings, the prior art has heretofore provided a three valve system for effecting inflation of an inflatable packer. The three valves are respectively well known as a locking shut-off valve, a poppet valve and an inflate limit valve which are connected in series to transmit a fluid pressure from the interior of a hollow mandrel to the interior of an annular inflatable packing element which surrounds the mandrel. The three valves are disposed in a tubular valve collar within which the valves are mounted in chordal relationship. The tubular valve collar surrounds the mandrel and is sealingly secured to one end of the annular inflatable element.

The locking shut-off valve prevents any fluid flow into the valving system until the fluid pressure within the mandrel bore exceeds the well bore pressure by a preselected amount. Once such pressure is supplied, the locking shut-off valve moves to a fully open position permitting fluid to flow to the poppet valve which in turn opens at a low pressure to supply pressure to the inflate limit valve. The inflate limit valve transmits the pressure supplied from the poppet valve to the interior of the inflatable element of the inflatable packer. A return conduit from the inflate chamber of the inflatable packing element applies a counteracting pressure to the valve element of the inflate limit valve to cut off further fluid flow from the poppet valve when the inflatable element is fully inflated A subsequent reduction in fluid pressure within the bore of the hollow mandrel permits the locking shut-off valve to return to a closed, locked position relative to the conduit connecting such valve element with the mandrel bore and the poppet valve also assumes a closed position under a spring and inflatable element pressure bias.

This system has functioned well when the inflatable packer is inflated by hydrocarbon fluids commonly employed in wells. In some applications, it is desirable to inflate the packer with cementing fluid and thus achieve the permanent inflation of the packer with a solid filling of cement. The greater viscosity and solids content of the cementing fluid results in substantial flow damage to the poppet valve and inflate limit valve. Since these valves are mounted in chordal relationship in the tubular wall of the valve collar, it is not possible to increase the flow area through these last mentioned valves by merely increasing the dimensions of such valves because they already occupy all of the space permitted by the relatively small wall thickness of the tubular valve collar.

There is, therefore, a definitive need for modifying a conventional three valve system to increase flow areas through the poppet and inflate limit valves to reduce flow velocity and damage caused by high velocity flow.

SUMMARY OF THE INVENTION

In accordance with this invention, an additional poppet valve and inflate limit valve are respectively provided in the tubular wall of the valve collar to function in parallel with the existing poppet valve and inflate limit valve, thereby substantially doubling the flow area through the poppet and inflate valves, and into the inflation chamber of the inflatable packer Such additional valves are provided by forming chordally disposed valve receiving bores in the same vertical planes respectively as the existing poppet valve and inflate limit valve, with the inner ends of the new bores lying respectively adjacent to the inner ends of the existing poppet valve and inflate limit valve bores. Fluid conduits are then provided in the wall of the valve collar from the locking shut-off valve to supply pressured fluid passing through such valve to both of the poppet valves in parallel, and additional conduits in the valve collar wall connect both poppet valves respectively to input ports of the two inflate limit valves. Similarly, radial conduits are provided in the valve collar wall from both inflate limit valves to the inflation chamber of the inflation packer, and return conduits are also provided from the inflation chamber to the axially inner ends of the two inflate limit valves.

With this arrangement, the flow of a heavy density fluid, such as cementing fluid, will be supplied through the two sets of the serially connected poppet valve and inflate limit valve to the inflation chamber at substantially the same rate as such fluid can pass through the inflate shut-off valve. Thus the flow rate and total volume passing through each individual set of serially connected poppet valve and inflate limit valve is approximately one half of what it would be in prior art systems.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
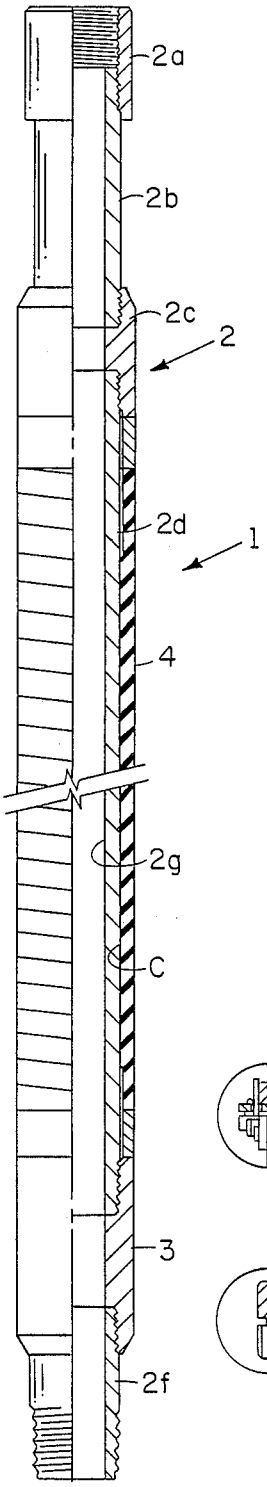
FIG. 1 (PRIOR ART)
FIG. 1 is a schematic vertical quarter sectional view of a prior art inflatable packer.

Referring to FIG. 1, a conventional inflatable packer a packer assemblage 1 is schematically shown comprising a mandrel assemblage 2 including a top sub 2*a* for connection to the bottom end of a casing string extending to the well surface. An extension sleeve 2*b* is threadably connected to the bottom of top sub 2*a* and is secured to the top end of a nipple 2*c*. The bottom end of nipple 2*c* is secured to the top end of a major sleeve portion 2*d* of the mandrel assemblage which underlies an inflatable packing element 4. The bottom end of sleeve 2*d* is threadably connected to a top end of a valve collar 3. The lower end of valve collar 3 is threadably connected to a nipple 2*f* which terminates the mandrel assemblage and permits the connection of any other tools desired to be connected to the bottom of the inflatable packer. The inflatable packing element 4 is conventionally sealably mounted between nipple 2*c* and valve collar 3 and comprises an elastomeric element which is expandable by fluid pressure introduced between the inner face of the tubular elastomeric element 4 and the outer surface of the main mandrel sleeve portion 2*d*.

Figure 2:
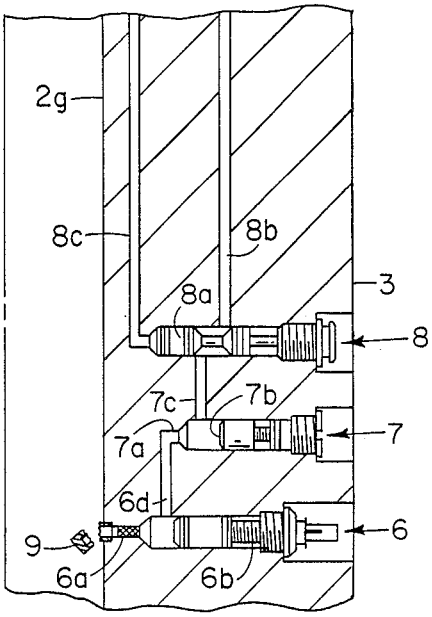
FIG. 2 (PRIOR ART)
FIG. 2 is an enlarged scale, vertical sectional view of the portion of the inflatable packer of FIG. 1 containing the valving elements.

The inflating pressure is normally supplied through the bore 2*g* of the mandrel assemblage 2 and is supplied to the chamber C between the inner surface of the inflatable packing element 4 and the outer surface of the mandrel sleeve portion d through a series of three valves 6, 7 and 8 which are respectively connected in series by suitable conduits provided in the wall of the valve collar 3. The lowermost valve 6 is known as a locking shut-off valve and is described in several prior art patents and catalogues. For example, see FIG. 5 of U.S. Pat. No. #RE32,345. In such prior art constructions, the locking shut-off valve 6 is normally connected by a radial conduit 6*a* to the bore 2*g* of the mandrel assemblage 2 through a shearable plug 9 which, when inflation of the packing element 4 is desired, is sheared off by a pump down plug. The locking shut-off valve 6 is spring biased to a closed position and is also biased to a closed position by any excess of the annulus pressure surrounding the inflatable packer over the pressure existing in the mandrel bore 2*g*. When the fluid pressure in the mandrel bore 2*g* is increased to a predetermined level above the annulus pressure, the valve element 6*b* is shifted against the biasing forces, as shown in FIG. 2, to open fluid passage into a radial conduit 6*d* formed in the wall of the valve collar 3 and extending to a conduit 7*a* which is axially connected to the inner end of the bore containing the check valve 7. The valve element 7*b* of check valve 7 is similarly biased to a closed position by a spring, and when such spring force is overcome by the applied fluid pressure, the check valve 7 opens and permits fluid to flow to a radial passage 7*c* leading to an inflate limit valve 8.

In many prior art inflation systems the locking shut-off valve is replaced by a delayed inflation valve which performs a similar function in delaying inflation of the inflatable packer until the tubing fluid pressure reaches a predetermined level above the hydrostatic pressure. See, for example, BAKER SERVICE TOOLS brochure entitled "UNIT 4259, dated Mar. 15, 1988" and published by BAKER SERVICE TOOLS Division of BAKER HUGHES INCORPORATED. Thus, these two types of prior art valves will be hereinafter generally referred to as inflation initiating valves.

The inflate limit valve 8 controls the flow of fluid through an axial passage 8*b* to the chamber C defined between the interior of the inflatable packing element 4 and the exterior of the mandrel sleeve portion 2*d*. A return passage 8*c* is also provided in the wall of valve collar 3 between an axial port in the inflate limit valve and the interior of the aforementioned inflation chamber, and the fluid pressure returned through conduit 8*c* effects the shifting of the valve element 8*a*, closing the inflate limit valve 8 to prevent the further supply of fluid to the inflatable packer when the packing element 5 is fully inflated.

With this prior art arrangement, whenever an abrasive fluid, such as cementing fluid, is utilized for inflation purposes, such fluid does no serious damage in passing through the inflation initiating valve but its flow substantially damages the check valve 7 and the inflate limit valve 8.

It is not possible to increase the flow area through the valve elements 7 and 8 due to the fact that they already occupy all of the permissible space provided by the wall thickness of the valve collar 3. Obviously, the internal diameter of valve collar 3 should not be less than the internal diameter 2*g* of the mandrel assemblage 2 and similarly, the external diameter of valve collar 3 should not exceed the collapsed diameter of the inflatable packer so as to permit the deflated packer to be inserted into the well through an existing installed casing string.

Figure 3:
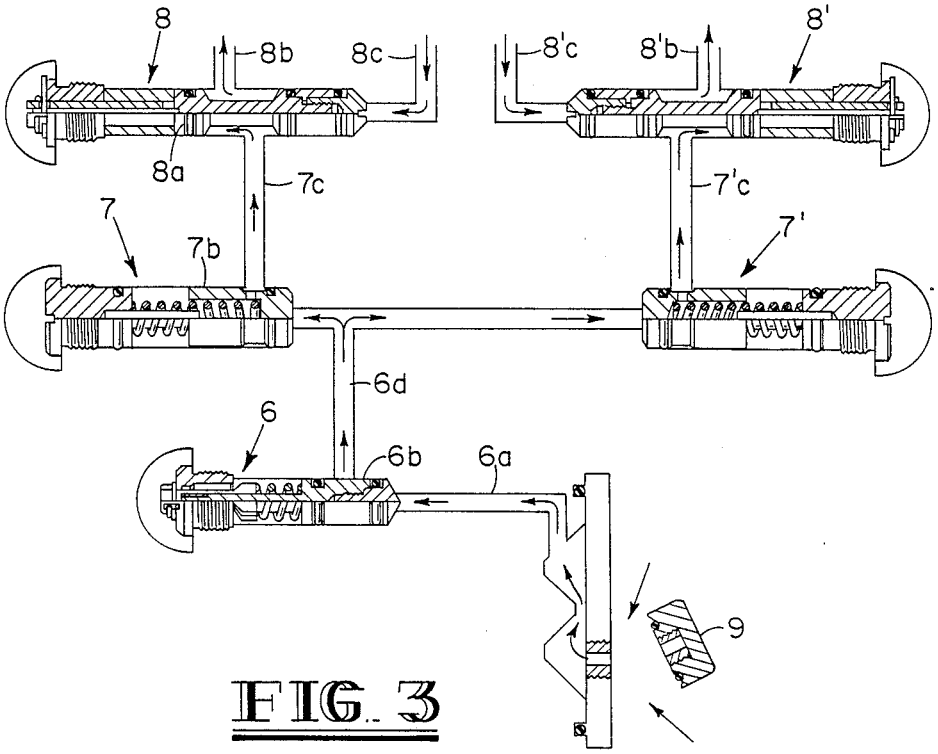
FIG. 3 is a schematic hydraulic circuit view of a valving system for an inflatable packer embodying this invention.

In accordance with this invention, which is schematically illustrated in FIG. 3, the problem is overcome by providing two additional series connected valves 7' and 8', which are respectively duplicates of the check valve 7 and the inflate limit valve 8, and connecting such duplicate valves in parallel with the prior art valves. Thus, the fluid flow passages through the check valves and inflate limit valves is effectively doubled and the flow velocity of viscous fluid through such valves is substantially decreased.

Figure 4:
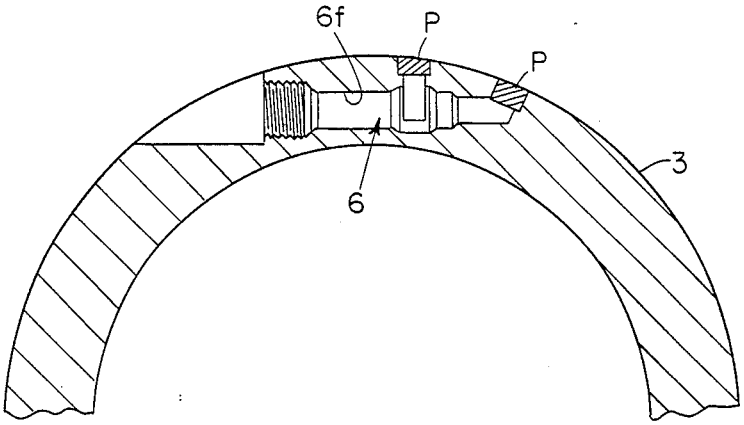
FIG. 4 is a horizontal sectional view taken through that portion of the valve collar containing the locking shutoff valve.
Figure 5:
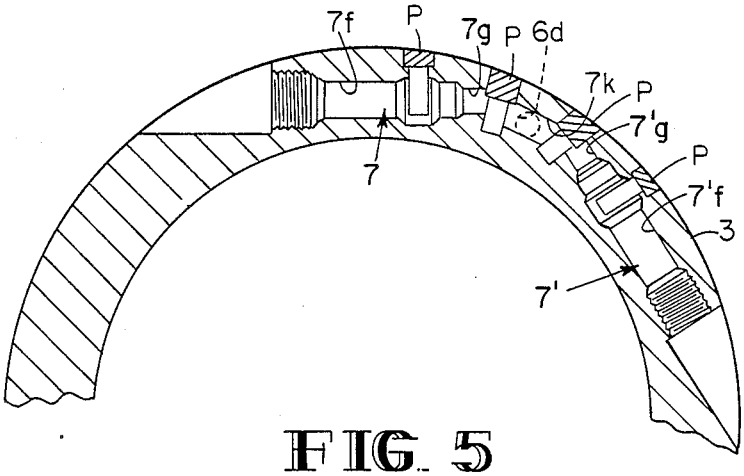
FIG. 5 is a horizontal sectional view taken through that portion of the valve collar containing the check valve.
Figure 6:
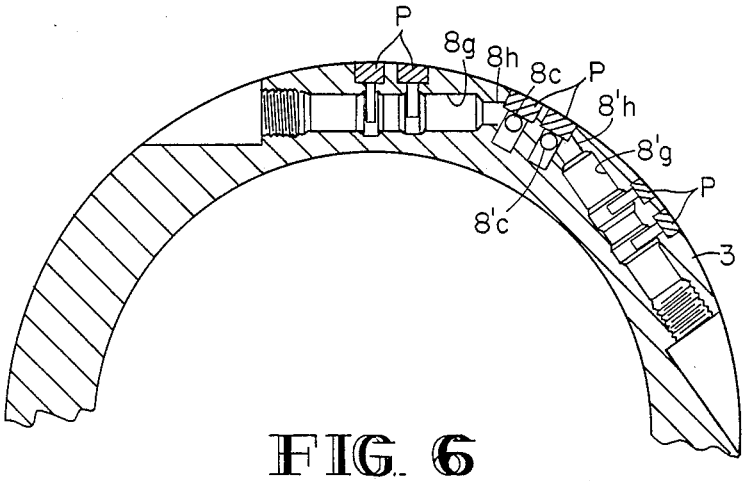
FIG. 6 is a horizontal sectional view taken through that portion of the valve collar containing the inflate limit valve.

The installation of such duplicate valves is accomplished in the manner that is illustrated in FIGS. 5 and 6. Referring to FIG. 5, it will noted that the existing check valve 7 is mounted in a chordal bore 7*f* having an internal end 7*g*. Such bore is located above the chordal bore 6*f* (FIG. 4) containing the inflation initiating valve 6. A second chordal bore 7'*f* is provided having an internal end 7'*g* disposed adjacent to the inner end 7*g* of the bore 7*f*. These bores can thus be readily connected in parallel to a vertical conduit extending upwardly from the locking inflation initiating valve, 6. Such vertical conduit is indicated schematically in FIG. 3 as 6*d*. The fluid conduit connections to the inner ends of the chordal check valve units 7 and 7' is indicated at 7*k*. Each of the check valve units 7 and 7' have vertically extending conduits 7*c* and 7'*c* extending upwardly to the inflate limit valves where they intersect the valve bores 8*g* and 8'*g*. All milled slots are covered with metal plates P that are welded in place.

Referring to FIG. 6, it will be noted that the valve bores 8*g* and 8'*g* are disposed in chordal relationship to the walls of the valve collar 3 and are located in the same plane with their inner bore ends 8*h* and 8'*h* disposed in proximity. Such inner ends are connected by vertical conduits 8*c* and 8'*c* to function as the return conduits from the inflation chamber C. The inflating conduits 8*b* and 8'*b* extend axially from the valve bores 8*g* and 8'*g* to such inflation chamber, as indicated in FIG. 3.

Those skilled in the art will recognize that the aforedescribed construction completely resolves the problem of inadequate flow passage area through the check valve 7 and the inflate limit valve 8 of a conventional three valve control systems for inflatable packers. The effective flow area through portions of the valving system is effectively doubled and this reduces the velocity of flow for an abrasive fluid, such as cementing fluid, which is often utilized as the inflating fluid for the inflatable packer. Lower velocity flow greatly reduces damage to the valves.

It will be further recognized that the check valves 7 and 7' may be connected to the outlets 8*b* and 8'*b* of the inflate limit valves if desired.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A tubular system for use in packing off a well bore, comprising:

a tubular mandrel having means on its upper end for connection to a well conduit extending to the well surface;

an annular inflatable packing element surrounding said mandrel and having one end sealingly attached to the mandrel;

a tubular valve collar surrounding said mandrel and sealingly attached to the other end of said packing element;

said valve collar having a first valve receiving bore axially communicating between the well bore and bore of said mandrel;

a first fluid conduit in said valve collar radially communicating with said first valve receiving bore;

an inflation initiating valve element mounted in said first valve receiving bore and having a pair of axially spaced seals initially straddling said first fluid conduit;

said inflation initiating valve element being axially shiftable by a predetermined fluid pressure in the bore of said mandrel to a position permitting said mandrel bore pressured fluid to unrestrictedly flow into said first fluid conduit;

said valve collar defining a pair of second valve receiving bores having adjacent axial ends;

second conduit means connecting said first fluid conduit to the adjacent axial ends of both said second valve bores;

said second conduit means having a flow area equal to that of said first conduit means;

check valves respectively mounted in said second valve bores and spring biased to a position limiting fluid flow from said first conduit means;

a pair of third conduit means respectively radially communicating with said second valve bores;

the combined flow areas through said pair of third conduit means and the respective check valves being approximately double the flow area of said first conduit means and said inflation initiating valve when opened;

said valve collar defining a pair of third valve receiving bores having adjacent axial ends;

said pair of third conduit means respectively radially communicating with said third valve bores;

a pair of inflate limit valves respectively mounted in said third valve bores;

a pair of fourth conduit means respectively radially communicating with said third valve bores and the space between said mandrel and the internal surface of said inflatable packing element;

the combined flow areas through said pair of third and fourth conduit means and said inflate limit valves being approximately double that of said first conduit means and said inflation initiating valve when opened, whereby the supply of pressured fluid to the bore of said mandrel at a predetermined level in excess of the well bore pressure produces a combined fluid flow rate through each of said check valves and each of said inflate limit valves substantially equal to one half the flow rate through said inflation initiating valve when opened.

2. The apparatus of claim 1 wherein each of said valve receiving bores is disposed in horizontal chordal relation in the tubular wall of said valve collar.

3. The apparatus of claim 2 wherein said second valve receiving bores are spaced vertically above said first valve receiving bore and said third valve receiving bores are spaced vertically above said second valve receiving bores.

4. The apparatus of claim 1 wherein the outer end of each said valve receiving bore communicates with the well bore and the other end of each said valve receiving bore terminates within the tubular wall of said valve collar.

5. A tubular system for use in packing off a well bore, comprising:

a tubular mandrel having means on its upper end for connection to a well conduit extending to the well surface, an annular inflatable packing element surrounding said mandrel and having one end sealingly attached to the mandrel;

a tubular valve collar surrounding said mandrel and sealingly attached to the other end of said packing element;

said valve collar having a first valve receiving bore axially communicating between the well bore and bore of said mandrel;

a first fluid conduit in said valve collar radially communicating with said first valve receiving bore;

an inflation initiating valve element mounted in said first valve receiving bore and having a pair of axially spaced seals initially straddling said first fluid conduit;

said inflation initiating valve element being axially shiftable by a predetermined fluid pressure in the bore of said mandrel to a position permitting said mandrel bore pressured fluid to unrestrictedly flow into said first fluid conduit;

said valve collar defining a pair of second valve receiving bores having adjacent axial ends;

second conduit means connecting said first fluid conduit to the adjacent axial ends of both said second valve bores;

said second conduit means having a flow area equal to that of said first conduit means;

first valve means respectively mounted in said second valve bores;

a pair of third conduit means respectively radially communicating with said second valve bores;

the combined flow areas through said pair of third conduit means and the respective first valve means being about double the flow area of said first conduit means and said inflation initiating valve when opened;

said valve collar defining a pair of third valve receiving bores having adjacent axial ends;

said pair of third conduit means respectively radially communicating with said third valve bores;

a pair of second valve means respectively mounted in said third valve bores;

a pair of fourth conduit means respectively communicating with said third valve bores and the space between said mandrel and the internal surface of said inflatable packing element;

the combined flow areas through said pair of third and fourth conduit means and said second valve means being about double that of said first conduit means and said inflation initiating valve when opened, whereby the supply of pressured fluid to the bore of said mandrel at a predetermined level in excess of the well bore pressure produces a fluid flow rate through each of said first and second valve means substantially equal to one half the flow rate through said inflation initiating valve when opened.

6. The apparatus of claim 5 wherein one of said first and second valve means comprises a check valve and the other comprises an inflate limit valve.

* * * * *